US007285713B2

(12) United States Patent
Takabayashi

(10) Patent No.: US 7,285,713 B2
(45) Date of Patent: Oct. 23, 2007

(54) STRINGED MUSICAL INSTRUMENT EQUIPPED WITH SENSORS SENSITIVE TO VIBRATION COMPONENTS AND BRIDGE WITH BUILT-IN SENSORS

(75) Inventor: Yojiro Takabayashi, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 111 days.

(21) Appl. No.: 11/129,523

(22) Filed: May 13, 2005

(65) Prior Publication Data

US 2006/0011049 A1 Jan. 19, 2006

(30) Foreign Application Priority Data

Jul. 13, 2004 (JP) ..... 2004-206410

(51) Int. Cl.
*G10H 3/00* (2006.01)

(52) U.S. Cl. ..... 84/723; 84/725; 84/726; 84/730; 84/731

(58) Field of Classification Search ..... None
See application file for complete search history.

(56) References Cited

U.S. PATENT DOCUMENTS

| | | | | |
|---|---|---|---|---|
| 2,222,057 | A * | 11/1940 | Benioff | 84/729 |
| 3,325,580 | A * | 6/1967 | Barcus et al. | 84/731 |
| 3,453,920 | A * | 7/1969 | Scherer | 84/731 |
| 4,356,754 | A | 11/1982 | Fishman | |
| 4,860,625 | A * | 8/1989 | Mathews | 84/731 |
| 4,867,027 | A | 9/1989 | Barbera | |
| 5,123,326 | A | 6/1992 | Clevinger | |
| 5,911,171 | A | 6/1999 | Wong | |
| 5,945,622 | A * | 8/1999 | Yamada | 84/731 |
| 6,008,440 | A * | 12/1999 | Yamada | 84/291 |
| 6,255,565 | B1 | 7/2001 | Tamura | |
| 6,448,488 | B1 | 9/2002 | Ekhaus | |
| 6,791,023 | B2 * | 9/2004 | Nakaya | 84/736 |
| 2002/0157523 | A1 * | 10/2002 | Takabayashi | 84/731 |
| 2004/0255762 | A1 * | 12/2004 | Takabayashi | 84/730 |
| 2005/0011342 | A1 * | 1/2005 | Fishman | 84/730 |

FOREIGN PATENT DOCUMENTS

| | | |
|---|---|---|
| JP | SHO 53-26132 | 3/1978 |
| JP | SHO 53-109431 | 9/1978 |
| JP | SHO 56-22598 | 2/1981 |
| JP | HEI 3-20398 | 2/1991 |
| JP | HEI 5-94896 | 12/1993 |
| JP | 2000-148148 | 5/2000 |
| JP | 2000-250559 | 9/2000 |

* cited by examiner

*Primary Examiner*—Marlon Fletcher
(74) *Attorney, Agent, or Firm*—Morrison & Foerster LLP

(57) ABSTRACT

An electric acoustic stringed musical instrument is a combination between an acoustic stringed musical instrument and an electric system; while a player is bowing on the strings, the strings not only laterally vibrate but also are repeatedly elongated and shrunk so as to give rise to rolling motion and pitching motion of the bridge; a strain sensor sensitive to the lateral component force of the vibrations and another strain sensor sensitive to the longitudinal component force are provided in and on the bridge for producing electric signals; since the timbre of tones is varied dependent on the ratio between the lateral component force and the longitudinal component force, the player can express his artistic expression in the electric tones by strongly or gently pressing the bow onto the strings.

16 Claims, 6 Drawing Sheets

STRINGED MUSICAL INSTRUMENT EQUIPPED WITH SENSORS SENSITIVE TO VIBRATION COMPONENTS AND BRIDGE WITH BUILT-IN SENSORS

FIELD OF THE INVENTION

This invention relates to a stringed musical instrument and, more particularly, to an electric stringed musical instrument and a bridge with built-in vibration sensors incorporated in the electric stringed musical instrument.

DESCRIPTION OF THE RELATED ART

The musical instrument is broken down into two categories, i.e., acoustic musical instruments and electrically-assisted musical instruments. The electrically-assisted musical instruments are connected to a speaker system through amplifiers so as to generate the electric/electronic sound, and, accordingly, the dynamic range is easily controllable. On the other hand, players generate the acoustic sound through the vibrations of the acoustic musical instruments so that the dynamic range is less controllable rather than the electrically-assisted musical instruments.

While a player is performing a piece of music on an acoustic musical instrument in ensemble with other sorts of acoustic musical instruments, the players do not feel it difficult to balance the loudness among the parts of the piece of music. The player is assumed to perform a piece of music on the acoustic musical instrument in ensemble with an electric/electronic musical instrument in a concert hall. The acoustic tones are drowned in the loud electric/electronic tones in so far as the acoustic musical instrument is not assisted by a microphone system.

Although the microphone system can keep the loudness of the acoustic sound balanced with the electronic/electronic sound, the microphone tends to pick up noise. The noise is also amplified through the amplifiers, and is offensive to the ears of the audience.

A compromise has been proposed. The compromise is fabricated on the basis of the acoustic musical instrument. The compromise is fabricated on the basis of an acoustic musical instrument, and is equipped with a vibration-to-electric signal transducer. While a player is performing on the compromise, he or she gives rise to vibrations of the acoustic musical instrument, and the vibrations of acoustic musical instrument are converted to an electric signal through the transducer. The electric signal is supplied through amplifiers to loud speakers as similar to the electric/electronic musical instrument, and the tones are radiated from the loud speakers at large loudness. However, the vibration-to-electric signal transducer ignores the noise. Thus, the players can generate the loud tones through the compromise, and, for this reason, the compromise is preferable to the acoustic musical instrument for the ensemble together with the electric/electronic musical instrument.

The compromise is hereinafter referred to as "electric acoustic musical instrument". Typical examples of the electric acoustic stringed musical instrument are disclosed in U.S. Pat. Nos. 2,222,057, 4,867,027 and 4,860,625. Strain sensors serve as the vibration-to-electric signal transducers of the prior art electric acoustic musical instrument, and are embedded in bridges, which give tension to the strings. While a player is performing on the prior art electric acoustic musical instrument, the vibrations are propagated from the vibrating strings to the bridge, and the bridge makes the prior art sensor strained depending upon the vibrations.

Thus, the prior art strain sensor converts the strain to the electric signal representative of the vibrations.

However, the user feels the electric tones different from the acoustic tones. In other words, the strain sensors can not exactly simulate the vibrations of the acoustic stringed musical instruments. For example, when the player delicately changes the bowing, the prior art strain sensors can not transfer the delicate nuance to the electric signal. This results in frustration of the player.

SUMMARY OF THE INVENTION

It is therefore an important object of the present invention to provide a stringed musical instrument, which can impart the delicate nuance to electric tones.

It is also important object of the present invention to provide a bridge with built-in vibration sensors which is preferably used in the stringed musical instrument.

The present inventor contemplated the problem inherent in the prior art electric acoustic stringed musical instrument, and noticed the prior art strain sensor anisotropic to the vibrations propagated through the bridge. In detail, the bridge stood on the soundboard of the acoustic string musical instrument, and gave the tension to the strings stretched between the pegs and the tailpiece. The strain sensors were arranged in such a manner as to be sensitive to the component force in the lateral direction, but were less sensitive to the component force in the direction of tension. However, the bridge vibrated not only in the lateral direction but also in the direction of tension. This was because of the fact that the bowing had given rise to the elongation of the strings and recovery to the original length. Although those component forces were exerted on the strain sensors, the prior art strain sensors merely converted the component force in the lateral direction to the current. For example, when the player changed the bowing from a forte to a piano or vice versa, the strings were elongated differently from those before the change. The prior art strain sensors could not convert the change to the amount of current. However, the present inventor found the vibration in the direction of tension to be important for the delicate nuance. The present inventor concluded that the sensors were to be isotropic to the vibrations propagated through the bridge.

In accordance with one aspect of the present invention, there is provided a n electric stringed musical instrument for electrically producing tones comprising a stringed musical instrument including a body structure having a longitudinal direction and lateral direction, a bridge held in contact with a major surface of said body structure and at least one string stretched over the major surface in the longitudinal direction and held in contact with the bridge so that vibrations thereof are propagated to the bridge, and an electric system including a pickup unit connected to the bridge and sensitive to a component force of the vibrations in the longitudinal direction and another component force of the vibrations in the lateral direction so that the vibrations are converted to an electric signal representative of the component force and the another component force.

In accordance with another aspect of the present invention, there is provided a bridge incorporated in an electric stringed musical instrument comprising a plate having major surfaces and end surfaces each narrower than one of the major surfaces, held in contact at one of the end surfaces with a body structure of the electric stringed musical instrument and pressed to the body structure by at least one string held in contact with another of the end surfaces so that vibrations are propagated from the aforesaid at least one string therethrough, and a pickup unit connected to the plate and sensitive to a component force of the vibrations in a longitudinal direction of the aforesaid at least one string and another component force of the vibrations in a lateral direction crossing the longitudinal direction at right angle so that the vibrations are converted to an electric signal representative of the component force and the aforesaid another component force.

BRIEF DESCRIPTION OF THE DRAWINGS

The features and advantages of the stringed musical instrument and bridge with built-in sensors will be more clearly understood from the following description taken in conjunction with the accompanying drawings, in which.

DESCRIPTION OF THE PREFERRED EMBODIMENTS

Figure 1:
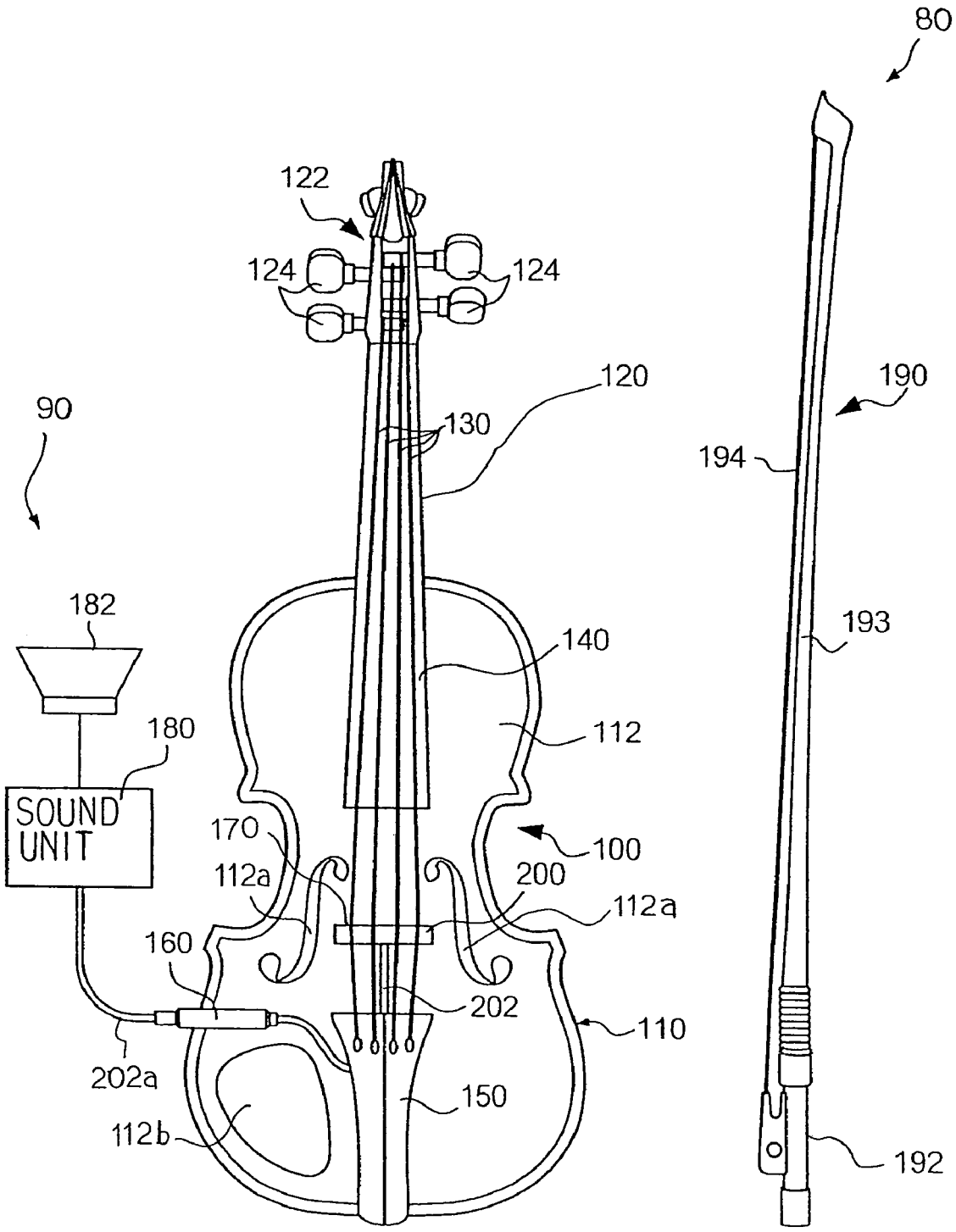
FIG. 1 is a plane view showing an electric acoustic musical instrument and a bow.

An electric stringed musical instrument largely comprises a stringed musical instrument and an electric system. Strings are incorporated in the stringed musical instrument, and a bridge stands on a major surface of a body structure of the stringed musical instrument. The strings are stretched over the major surface, and are anchored at both ends thereof to the body structure. Since the strings are held in contact with the bridge, the bridge is pressed to the major surface. While a player is performing a piece of music on the electric stringed musical instrument, he or she selectively gives rise to vibrations of the strings.

A pickup unit, which forms a part of the electric system, is provided in the vicinity of the strings, and is connected to the bridge. The vibrations are propagated from the vibrating strings to the pickup unit, and are converted to an electric signal through the pickup unit.

The pickup unit is sensitive to not only component force of the vibrations in the longitudinal direction of the strings but also component force of the vibrations in the lateral direction, which crosses the longitudinal direction at right angle. Accordingly, the electric signal contains the signal component expressing the component force in the longitudinal direction and the signal component expressing the component force in the lateral direction.

Since the timbre of tones is varied depending upon the ratio between the component force in the longitudinal direction and the component force in the lateral direction, the player can vary the timbre of tones and imparts artistic expression to the tones by increasing or decreasing the force exerted on the strings. Thus, the player offers the expressive performance to the audience through the electric stringed musical instrument according to the present invention.

In case where the stringed musical instrument is equipped with a bridge, it is preferable to provide the pickup unit in the bridge. While the player is performing a music passage on the electric stringed musical instrument, the vibrating string gives rise to not only rolling of the bridge but also pitching thereof. The lateral component force and longitudinal component force are converted to the electric signal through the pickup unit, and the electric tones are produced on the basis of the electric signal. The player is assumed to increase or decrease the pressure exerted on the at least one string, the ratio between the signal components is varied, and the timbre is delicately changed.

As will be understood from the foregoing description, the electric stringed musical instrument according to the present invention makes the performance rich in artistic expression.

In the following description, term "longitudinal" is indicative of a direction in parallel to strings of a stringed musical instrument, and term "perpendicular" is indicative of a direction normal to an upper surface of the stringed musical instrument. Term "lateral" is indicative of the direction normal to a plane defined by the longitudinal line and perpendicular line.

First Embodiment

Electric Acoustic Musical Instrument

Referring first to FIG. 1 of the drawings, an electric acoustic stringed musical instrument embodying the present invention largely comprises an acoustic stringed musical instrument 80 and an electric system 90. The electric system 90 is partially provided in the acoustic stringed musical instrument 80. However, the remaining electric system 90 is physically separated from the acoustic stringed musical instrument 80. A player gives rise to vibrations of the acoustic stringed musical instrument 80, and the electric system 90 electrically produces tones, i.e., electric tones on the basis of the vibrations of the acoustic stringed musical instrument 80.

In this instance, the acoustic stringed musical instrument 80 consists of a violin 100 and a bow 190, and a part 170 of the electric system 90 is embedded in the violin 100. The player gives rise to the vibrations of the violin 100 with the bow 190, and the vibrations are propagated to the part 170 of the electric system 90. The part 170 of the electric system 90 is sensitive to not only lateral component force but also longitudinal component force, and produces electric signals representative of the lateral component force and longitudinal component force. The electric system 90 is further operative to convert the electric signals to the electric tones. In other words, the part 170 is isotropic to the vibrations.

While the player is playing a piece of music on the electric acoustic stringed musical instrument, he or she is assumed to reduce the force exerted on the acoustic violin 100 with the bow 190. The longitudinal component force is immediately decreased, and the longitudinal component force makes the resultant force also decreased. This results in faint electric tones. Thus, the electric acoustic stringed musical instrument according to the present invention promptly responds to the change in blowing, and transfers the delicate nuance from the player to the electric tones.

Acoustic Violin

The acoustic violin 100 includes a body 110, a neck 120, a peg box 122, strings 130, a fingerboard 140, a string holder 150 and a bridge 200. A soundboard 112, a bottom board (not shown) and sideboards (not shown) form in combination the body 110, and a sound chamber is defined in the body 110. The soundboard 112 and bottom board (not shown) are constricted, and are spaced in the normal direction from each other. The sideboards extend along the peripheries of the sound board/bottom board, and are secured to the peripheries of the soundboard/bottom board so that the sound chamber is formed in the body 110. Sound holes 112*a* are formed in the soundboard 112, and make the sound chamber open to the ambience therethrough. A chin rest 112*b* is provided on the soundboard 112, and a player presses his or her chin to the chin rest 112*b* for holding the acoustic violin 100 between the chin and the upper thorax.

The neck 120 projects from one end portion of the body 110 in the longitudinal direction, and the peg box 122 is provided at the leading end of the neck 120. Four pegs 124 are turnably supported by the peg box 122, and their axes of rotation laterally extend. The fingerboard 140 is adhered to the neck 120, and extends in the longitudinal direction. The string holder 150 is connected to the other end portion of the body 110, and the bridge 200 is upright on the soundboard 112 between the fingerboard 140 and the string holder 150. The four strings 130 extend over the bridge 200, and are stretched between the pegs 124 and the string holder 150. The strings 130 are made of conductive material such as, for example, steel. The strings 130 press the bridge 200 to the soundboard 112. The bridge 200 will be described in detail together with the electric system 90.

A handle 192, a stick and hair 193 are assembled into the bow 190. The handle 192 is secured to one end of the stick 193, and the hair 194 is stretched between the other end of the stick 193 and the handle 192. The player holds the handle 192 with the right hand, and laterally moves the hair 194 on the strings 130 so as to give rise to the vibrations.

While a player is bowing, the strings 130 vibrate, and the vibrations are propagated from the strings 130 through the bridge 200 to the body 110. The vibrating strings 130 exert the longitudinal component force and lateral component force to the bridge 200, and the bridge 200 transfers both of the longitudinal component force and lateral component force to the body 110. The resultant force gives rise to vibration of the body 110, and the vibrating body 110 further gives rise to vibrations of the air, i.e., acoustic tones. The acoustic tones are amplified through the resonation in the sound chamber (not shown) so that relatively loud acoustic tones are radiated from the body 110. When the player changes the finger position on the fingerboard 140 toward the string holder 150, the vibrating strings 130 are shortened, and the acoustic tones are sharp pitched. Thus, the acoustic violin 100 and bow 190 are similar to a standard violin and its bow.

Electric System

The electric system 90 includes a connector 160, a sensor system 170, a sound unit 180, a sound radiator 182 and conductive leads 202/202*a*. As will be hereinlater described in detail, the sensor system 170, which is hereinbefore referred to as the "part of the electric system", is embedded in the bridge 200.

The sensor system 170 is connected through the conductive lead 202 to the connector 160, and the other conductive lead 202*a* is connected to and disconnected from the connector 160. The conductive lead 202*a* is connected at the other end thereof to the sound unit 180 so that the electric signals are supplied from the sensor system 170 through the conductive leads 202/202*a* to the sound unit 180.

A control amplifier and a power amplifier are incorporated in the sound unit 180 together with effectors. The electric signals are equalized and amplified in the sound unit 180, and the effectors are used for reverberation, echo and so forth when the player requests the electric system 90 to impart them to the electric tones. In this instance, the sound radiator 182 is implemented by loud speakers, and converts the electric signal to the electric tones.

When a player wishes to play a piece of music on the electric acoustic stringed musical instrument, he or she connects the conductive lead 202*a* to the conductive lead 202 through the connector 160, and appropriately tunes the sound unit 180. When the player gets ready to play, he or she keeps the acoustic violin 100 stable between the chin and the upper thorax, and starts to bow the strings 130 with the hair 194. While the player is bowing, he or she slides the fingers on the fingerboard 140 for changing the length of the vibrating strings 130 along the music passage. The strings 130 vibrate, and the vibrations are propagated from the strings 130 through the bridge 200 to the sensor system 170.

The sensor system 170 is sensitive to both of the longitudinal component force and lateral component force so as promptly to respond to change in bowing. The sensor system 170 converts the vibrations to the electric signals, and the electric signals are supplied from the sensor system 170 through the conductive leads 202/202*a* to the sound unit 180. The electric signals are mixed, equalized in frequency characteristics and amplified. The electric signal thus equalized and amplified in the sound unit 180 is supplied to the tone radiator 182, and is converted to the electric tones.

Figure 2:
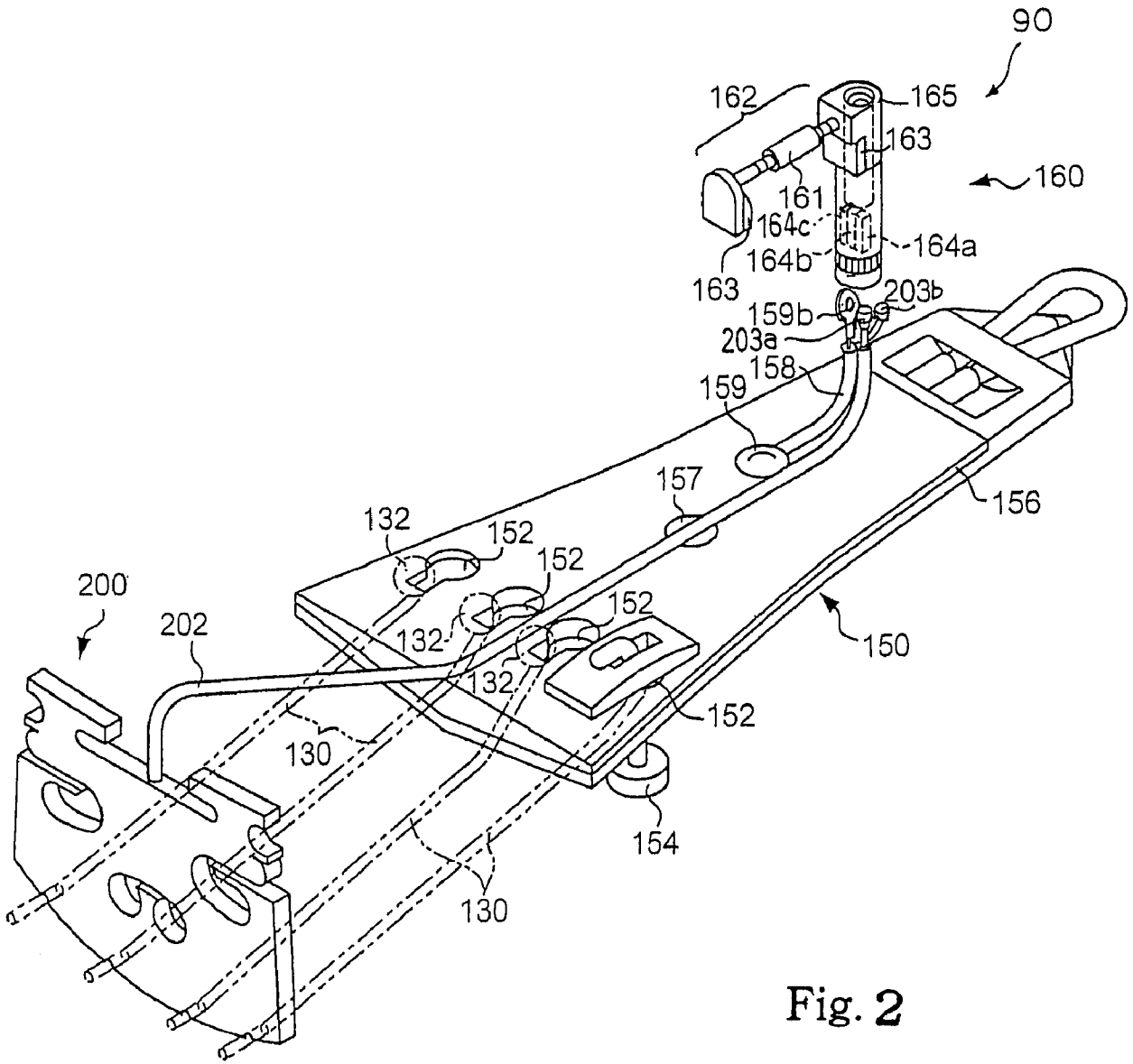
FIG. 2 is a perspective view showing the configuration of a bridge and a string holder incorporated in the electric acoustic stringed musical instrument.

Turning to FIG. 2 of the drawings, the string holder 150 and bridge 200 are illustrated in detail. The string holder 150 and bridge 200 are turned over so that the reverse surface of the string holder 150 is seen in FIG. 2. A conductive metal foil 156 is adhered to the reverse surface of the string holder 150, and the lamination of string holder 150 and conductive metal foil 156 is formed with four string holes 152, which are assigned to the four strings 130, respectively. In this instance, the conductive metal foil 156 is made of copper. However, another sort of conductive metal or alloy such as, for example, aluminum or aluminum alloy is available for the conductive metal foil 156. The string holes 152 have a contour like a keyhole, and a conductive adjuster 154 is prepared for one of the string holes 152. The strings 130 have respective conductive anchors 132. The three strings 130 are connected to the string holder 150 by means of the anchors 132, which are directly held in contact with the peripheries of the conductive metal foil 156 defining the string holes 152. The remaining string 130 is connected to the conductive metal foil 156 by means of the conductive adjuster 154. Thus, the strings 130 are electrically connected through the conductive anchors 132 and conductive adjuster 154 to the conductive metal foil 156. Since the player brings his or her fingers into contact with the strings 130, the conductive metal foil 156 becomes equal in potential level to the player, and offers the ground level to the strings 130. Although a player exerts tensile force through the strings 130 to the lamination of string holder 150 and conductive metal foil 156, the string holder 150 is tough enough to withstand the tensile force.

The bridge 200 is upright on the soundboard 112, and upwardly spaces the strings 130 from the soundboard 112. The bridge 200 is operative to propagate the vibrations from the strings 130 to both of the soundboard 112 and the electric system 90. The first function, i.e., propagating the vibrations from the strings 130 to the soundboard 112, is similar to the function of the bridge incorporated in a standard acoustic violin. While a player is bowing, the bridge 200 propagates the vibrations from the vibrating strings 130 to the soundboard 112, and gives rise to the vibrations of the body 110. The vibrations are enlarged through the resonance in the sound chamber, and loud acoustic tones are radiated from the body 110 as described hereinbefore. The other function will be hereinlater described in detail in conjunction with the electric system 90.

Figure 4:
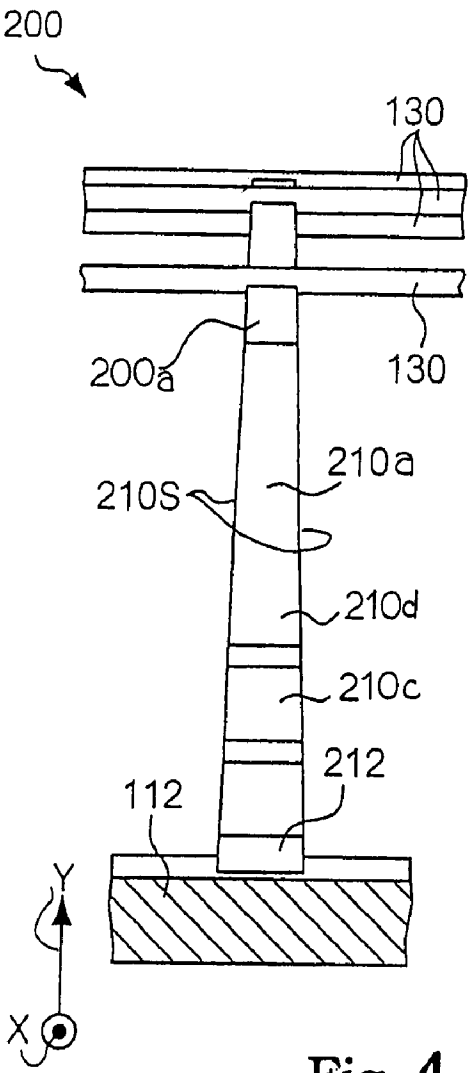
FIG. 4 is a side view showing the bridge on the soundboard.
Figure 3:
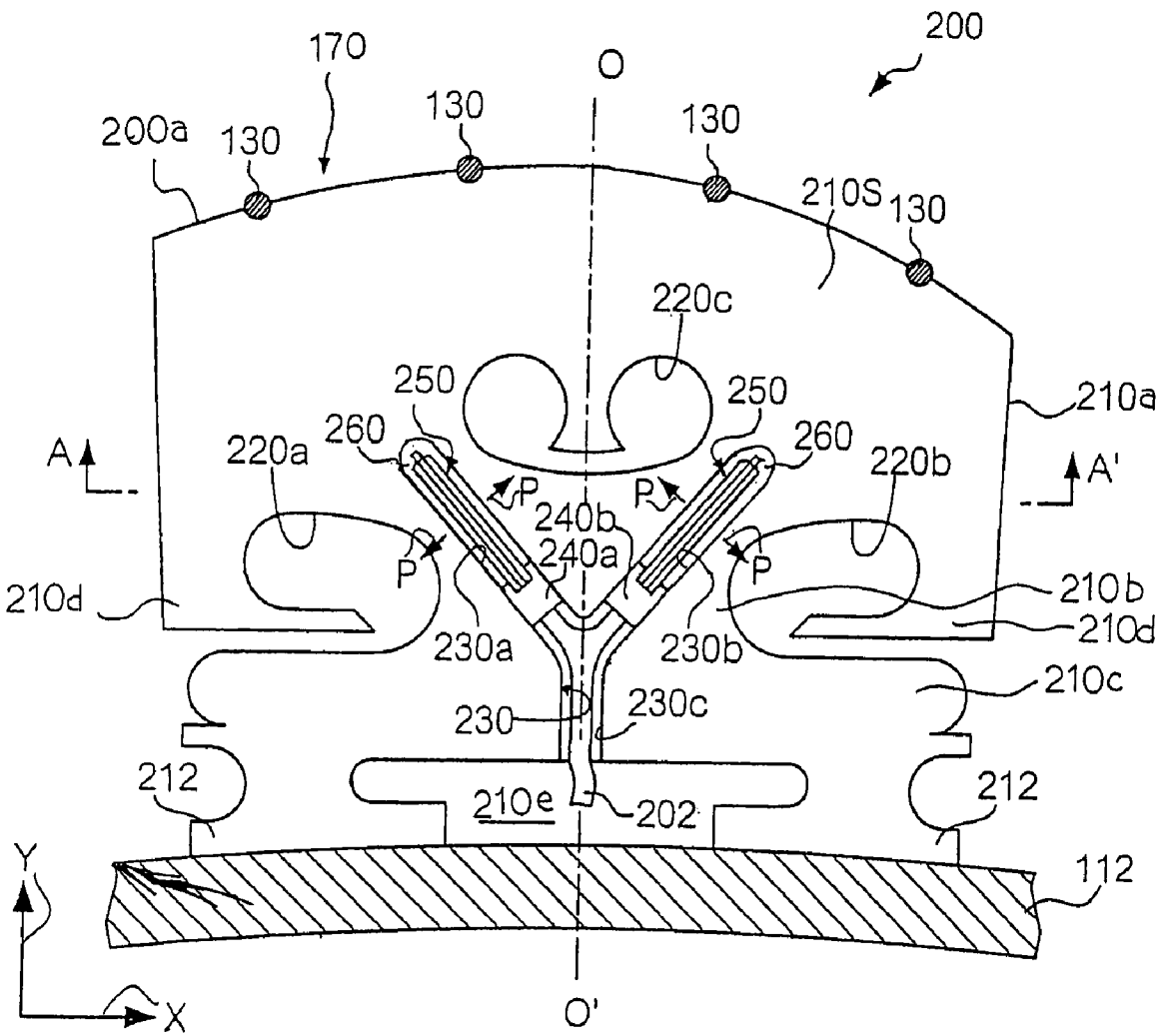
FIG. 3 is a front view showing a strain sensor for a lateral component force embedded in a bridge on a soundboard.

Turning to FIGS. 3 and 4, the bridge 200 stands on the soundboard 112. The bridge 200 is substantially vertical to the upper surface of the soundboard 112, and has major surfaces 210S, which extend in parallel to the lateral direction "X". In FIGS. 3 and 4, the lateral direction is indicated by an arrow "X", and the perpendicular direction is labeled with "Y".

The bridge 200 is made of wood such as, for example, maple, and is given in the form of a thin plate. The bridge 200 has an arc top surface 200*a*, and four notches are formed in such a manner as to come out on the arc top surface 200*a*. The four strings 130 are received in the notches, respectively. Pieces of wood are cut out from the thin wood plate so as to form three hollow spaces 220*a*, 220*b*, and 220*c*, and the hollow spaces 220*a* and 220*b* divide the bridge 200 into three portions, i.e., an arch portion 210*a*, a constricted portion 210*b* and a bifurcated portion 210*c*. The left hollow space 220*a* and right hollow space 220*b* make the bridge 200 constricted, and the bridge 200 is bifurcated downwardly from the constricted portion 210*b*. The bifurcated portion 210*c* has a right foot 212 and a left foot, which are on the soundboard 112 as shown. Thus, the vibrations of the strings 130 are input to the arc surface 200*a*, make the bridge 200 deformed so as to be propagated through the arch, constricted and bifurcated portions 210*a*, 210*b* and 210*c*, and are output from the feet 212 to the soundboard 112.

The left hollow space 220*a* and right hollow space 220*b* have a contour like an inlet, and make the constricted portion 210*c* spaced from slant-arms 210*d* of the arch section 210*a*. The center hollow space 220*c* is formed in the arch portion 210*a*, and is substantially symmetrical with respect to the centerline O-O' of the bridge 200. The centerline O-O' is substantially perpendicular to the soundboard 112, and equally divides the width of the bridge 200. The bifurcated portion 210*c* defines a gap 210*e* between the right foot 212 and the left foot 212.

A groove 230 is formed in the bridge 200. The groove 230 has a trunk portion 230*c* and branch portions 230*a*/230*b*. The trunk portion 230*c* is open at the lower end thereof to the gap 210*e*, and upwardly extends through the bifurcated portion 210*c*. The centerline of the trunk portion 230*c* is substantially coincident with the centerline O-O' of the bridge 200. The trunk portion 230*c* branches to the branch portions 230*a* and 230*b* at the boundary between the bifurcated portion 210*c* and the constricted portion 210*b*, and the branch portions 230*a* and 230*b* obliquely upwardly extend through the constricted portion 210*b* into the arch portion 210*a*. The branch portions 230*a* and 230*b* extend in the arch portion 210*a* between the left hollow space 220*a* and the center hollow space 220*c* and between the right hollow space 220*b* and the center hollow space 220*c*, and are symmetrically arranged with respect to the trunk portion 230*c* and the centerline O-O'.

Sensor System

The sensor system 170 includes a strain sensor 250 for the lateral component force and a strain sensor 300 (see FIGS. 5 and 6) for the longitudinal component force. When the bridge 200 rolls on the soundboard 112, i.e., is laterally shaken, the strain sensor 250 is deformed, and varies the magnitude of the electric signal. In other words, the strain sensor 250 converts the lateral component force to the electric signal. On the other hand, when the bridge 200 pitches up and down, the other strain sensor 300 is deformed, and varies the magnitude of the electric signal. In other words, the strain sensor 300 converts the longitudinal component force to the electric signal.

Figure 7:
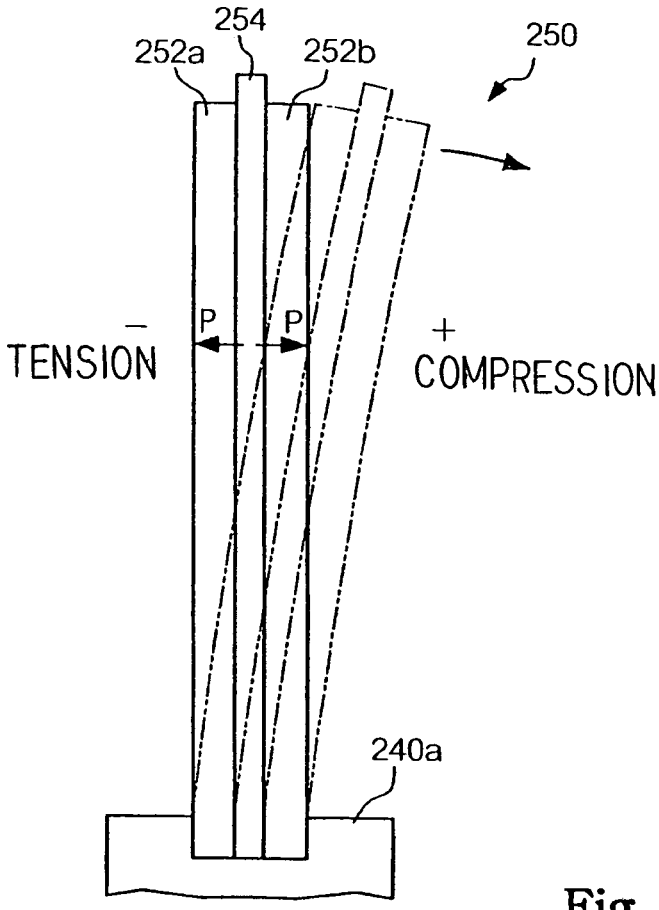
FIG. 7 is a front view showing the structure of a bimorph piezoelectric transducer embedded in the bridge.

The groove 230 is assigned to the strain sensor 250. In this instance, the strain sensor 250 is implemented by a pair of bimorph piezoelectric transducers 250, and the bimorph piezoelectric transducers 250 are respectively received in the branch portions 230*a* and 230*b*. The bimorph piezoelectric transducers 250 have respective sensor holders 240*a*/240*b*, which are, by way of example, made of synthetic resin, and the holders 240*a* and 240*b* are adhered to the constricted portions 210*b* in the vicinity of the bifurcation of the groove 230. The bimorph piezoelectric transducers 250 further have piezoelectric elements 252*a*/252*b* and a base plate 254 (see FIG. 7), and piezoelectric elements 252*a*/252*b* are made of piezoelectric single crystal, piezoelectric semiconductor, piezoelectric ceramic or piezoelectric polymer. The base plate 254 is made of metal, and the piezoelectric elements 252*a*/252*b* are adhered to both surfaces of the base plate 254 in such a manner that the direction of polarization P in the piezoelectric element 252*a* is opposite to the direction of polarization P in the other piezoelectric element 252*b*. In this instance, the direction of polarization P is from the inner surfaces adhered to the base plate 254 toward the outer surfaces.

When the piezoelectric elements 252*a*/252*b* are deformed from the position indicated by real lines to the position indicated by dots-and-dash lines, the tensile force and compressive force are respectively exerted on the piezoelectric element 252*a* and piezoelectric element 252*b*, positive electric charges are produced on the outer surface of the piezoelectric element 252*b* with respect to the outer surface of the other piezoelectric element 252*a*. The polarity of electric charge is dependent on the direction of deformation, and the electromotive force is proportional to the amount of deformation.

Turning back to FIGS. 3 and 4, the piezoelectric elements of the transducers 250 have a thickness less than the width of the branch portions 230*a* and 230*b* so that the piezoelectric elements 252*a*/252*b* extend in the branch portions 230*a* and 230*b* without any physical contact to the inner surfaces of the bridge 200. In other words, the piezoelectric elements 252*a*/252*b* are spaced from the inner surfaces, which define the branch portions 230*a*/230*b*, and the gap between the piezoelectric elements 252*a*/252*b* and the inner surfaces is filled with filler 260. For this reason, the vibrations are propagated through the arch/constricted portions 210*a*/210*b* to the filler 260, which in turn propagates the vibrations to the piezoelectric elements 252*a*/252*b* of bimorph piezoelectric transducers 250.

The filler 260 is made of substance in which no strain energy or a negligible amount of strain energy is accumulated during the deformation of the bridge 200 due to the vibrating strings 130. In other words, the filler 260 does not exhibit the elasticity. For this reason, although the bridge 200 repeatedly changes the direction of the force exerted on the filler 260, the filler 260 faithfully follows the bridge 200 so that the filler 260 correctly propagates the deformation of the bridge 200 to the piezoelectric elements 252*a*/252*b*. In this instance, the filler 260 is made of oil clay, i.e., mixture of oil and clay. The vibrations, which are propagated from the strings 130 to the bridge 200, cause the oil clay to be plastically deformed. For this reason, the vibrations are transferred to the piezoelectric elements 252*a*/252*b* without serious distortion, and the piezoelectric elements 252*a*/252*b* are free from the aftereffect due to the elastic strain energy.

The strain sensor 250 embedded in the bridge 200 is preferable to prior art pickup units provided between the body and the legs of the bridge. First, although the strings 130 push the bridge 200 downwardly, the downward component force is not exerted on the piezoelectric elements 252*a*/252*b*. For this reason, the pickup unit 170 exactly converts the vibrations to the electric signals.

Another advantage of the pickup unit 170 embedded in the bridge 200 is that the user can assemble the bridge 200 into and disassembled it from the acoustic violin 100 in a similar manner to those of standard acoustic violins. The pickup unit 170 does not change the height of the bridge on the soundboard 112. The can tune the strings 130 as usual.

Figure 6:
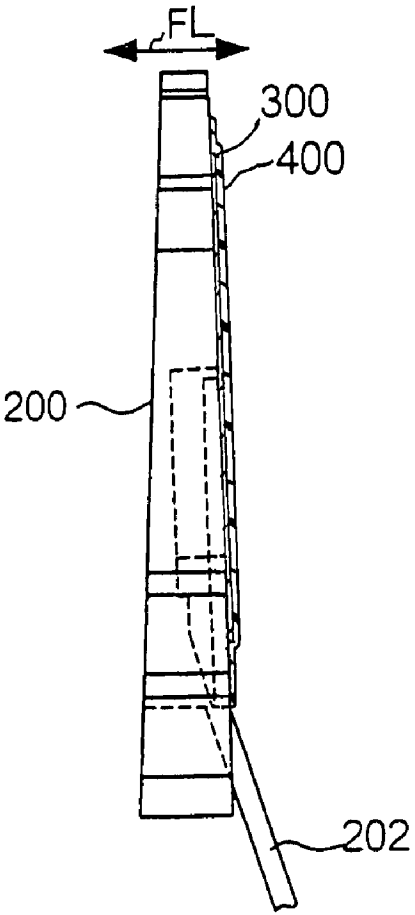
FIG. 6 is a side view showing the strain sensor attached to the bridge.
Figure 5:
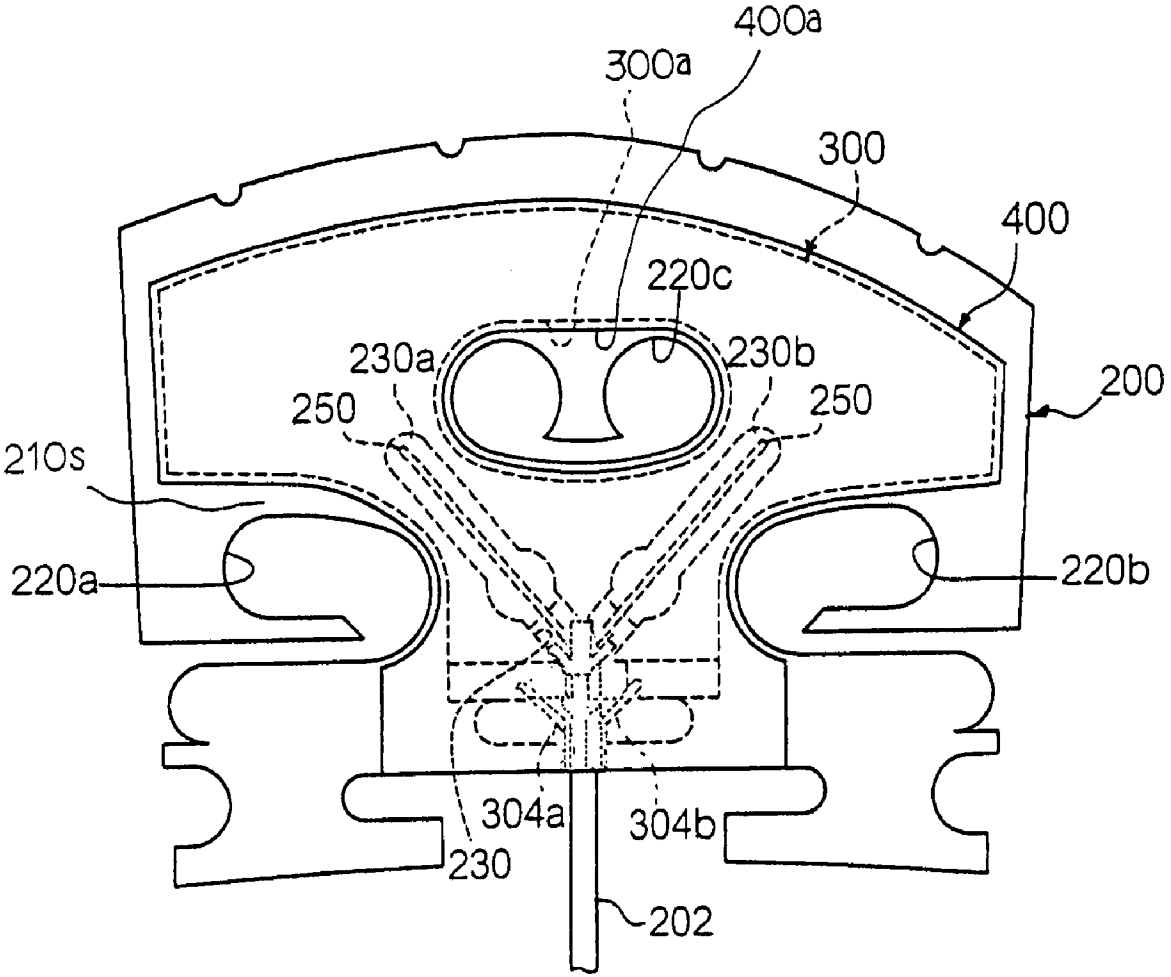
FIG. 5 is a front view showing another strain sensor for a longitudinal component force attached to the bridge.

Turning to FIGS. 5 and 6 of the drawings, the strain sensor 300 is adhered to the major surface 210*s* of the bridge 200. The strain sensor 300 is made in the form of film, and converts force FL, which is exerted on the strain sensor in the longitudinal direction, to electric charge. The amount of electric charge is proportional to the magnitude of force FL so that the force FL is measured as the potential level.

The strain sensor 300 has an outline like a ginkgo leaf, and the major surface 210*s* in most of the arch and constricted portions 210*a* and 210*b* is covered with the strain sensor 300. Although the strain sensor 300 slightly enters the major surface 210*s* in the bifurcated portion 210*c*, most of the bifurcated portion 210*c* is out of the detectable area of the strain sensor 300. An aperture 300*a* is formed in the strain sensor 300 so that the hollow space 220*c* is uncovered with the strain sensor 300. However, the strain sensor 300 extends over most of the groove 230. Thus, the piezoelectric transducers 250 are covered with the strain sensor 300.

The strain sensor 300 is covered with a bridge cover 400, and the bridge cover 400 is so flexible that the bridge 200 and strain sensor 300 can be deformed. The bridge cover 400 extends slightly beyond the periphery of the strain sensor 300, and protects the strain sensor 300 from undesirable damage. The bridge cover 400 deeply enters the bifurcated portion 210*c*, and reaches the edge partially defining the gap 210*e*. An aperture 400*a* is also formed in the bridge cover 400, and the aperture 300*a* nests in the aperture 400*a*. As a result, the hollow space 220*c* is exposed to the outside.

Figure 8:
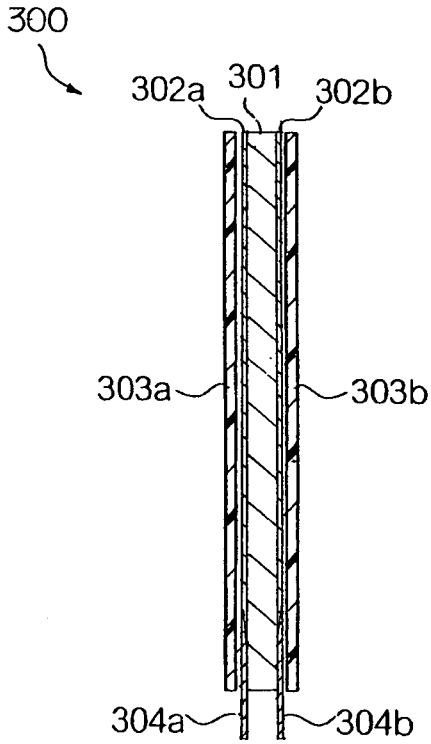
FIG. 8 is a side view showing the structure of a strain sensor adhered to the major surface of the bridge.

The structure of the strain sensor 300 is illustrated in FIG. 8. The strain sensor 300 has a multi-layered structure. An piezoelectric film 301, which is made of piezoelectric material such as piezoelectric single crystal, piezoelectric semiconductor, piezoelectric ceramic or piezoelectric polymer, has major surfaces, which are entirely covered with silver electrode plates 302*a* and 302*b*, and has the electromotive force. Conductive pins 304*a*/304*b* are caulked with the silver electrode plates 302*a*/302*b*, and the potential level is taken out from between the conductive pins 304*a*/304*b*. The piezoelectric film 301, silver electrode plates 302*a*/302*b* and parts of the conductive pins 304*a*/304*b* are sandwiched between protective layers 303*a* and 303*b*. The total thickness of strain sensor 300 is of the order of 0.1 millimeter so that the strain sensor 300 is well deformed while the force FL is being exerted on the strain sensor 300.

The electric system 90 includes the pickup unit 170, which is implemented by the combination of strain sensors 250 and 300, conductive leads 202/202*a*, connector 160, sound unit 180 and tone radiator 182 as described hereinbefore. The electric connection among those system components is hereinafter described in detail.

Figure 9:
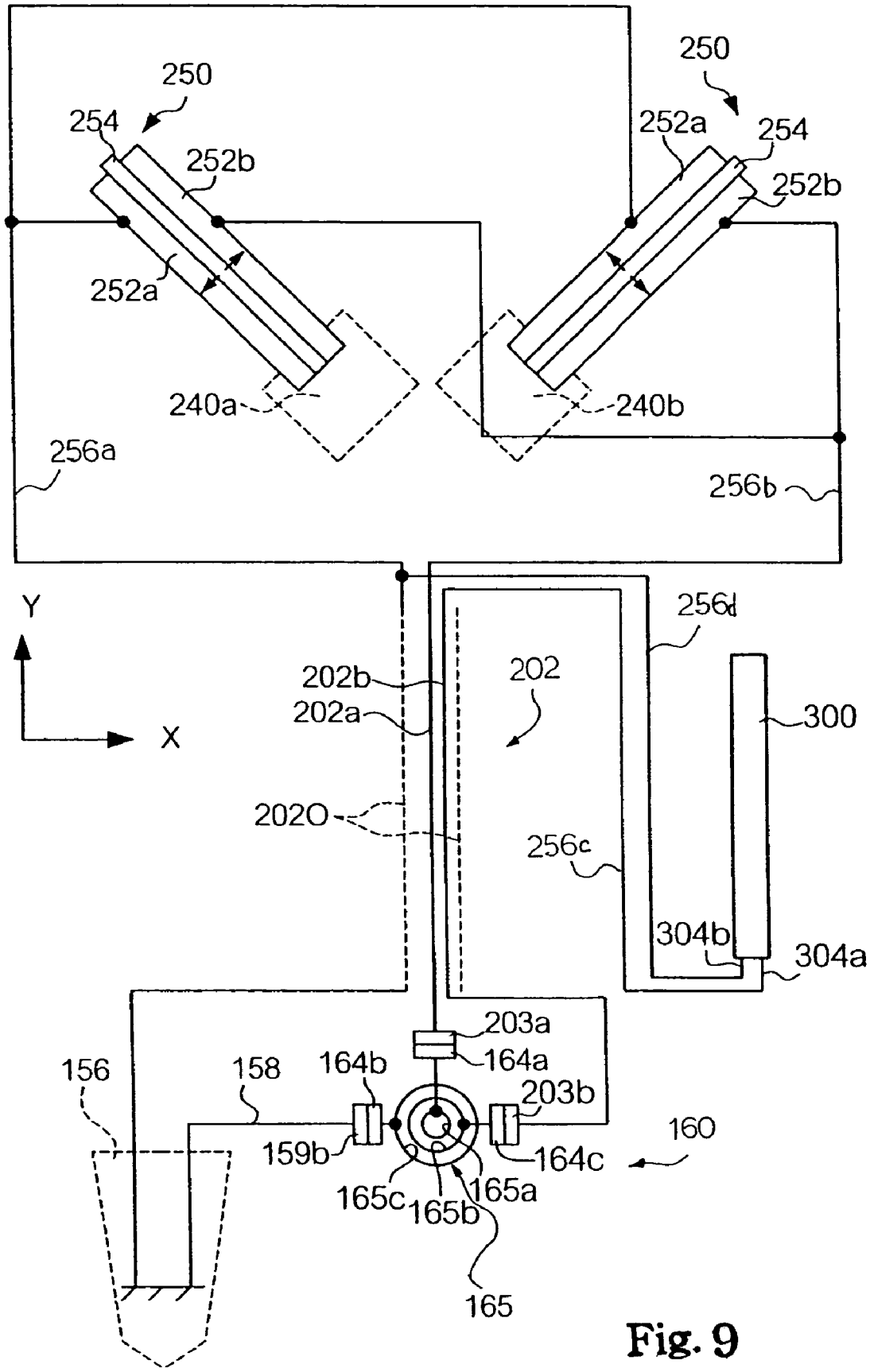
FIG. 9 is a circuit diagram showing the circuit configuration of a pickup unit forming a part of an electric system of the electric acoustic musical instrument.

Turning to FIG. 9 of the drawings, the pair of bimorph piezoelectric transducers 250 and strain sensor 300 are connected to the connector 160 through the conductive lead 202. The piezoelectric elements 252*a* are connected through a conductive line 256*a* to each other, and the other piezoelectric elements 252*b* are connected through another conductive line 256*b* to each other. The conductive line 256*a* is held in contact with the surfaces of the piezoelectric elements 252*a*, and the other conductive line 256*b* is also held in contact with the surfaces of the piezoelectric elements 252*b*. In other words, the bimorph piezoelectric transducers 250 are connected in parallel to the conductive lines 256*a*/256*b*. The conductive lines 256*a*/256*b* are connected to the conductive lead 202 (see FIG. 3).

The conductive pins 304*a*/304*b* are connected to conductive lines 256*c* and 256*d*, and the conductive lines 256*c*/256*d* are connected to the conductive lead 202 (see FIG. 5).

The conductive lead 202 includes inner conductive lines 202*a*/202*b* and an outer conductive strip 202O. The conductive line 256*b* is merged with the inner conductive line 202*a*, and the conductive line 256*c* is merged with the inner conductive line 256*c*. The outer conductive strip 202O is connected to both of the conductive lines 256*a*/256*d*.

The outer conductive strip 202O is connected at the other end thereof to the conductive metal foil 156 so that the grand potential is applied to the piezoelectric elements 252*a* and conductive pin 256*d* through the outer conductive strip 202O. Thus, the outer conductive strip 202O is effective against noise on the conductive lines 202*a*/202*b*.

On the other hand, the conductive lines 202*a*/202*b* are respectively terminated at contact 203*a*/203*b*, which is electrically connected to terminals 164*a*/164*c*. The conductive metal foil 156 is connected through a ground line 158 to a contact 159*b*, and the contact 159*b* is electrically connected to the terminal 164*b*. The contacts 203*a*/203*b*/159*b* are connected to and disconnected from the terminals 164*a*/164*c*/164*b*, and the terminals 164*a*/164*c*/164*b* are connected to contacts 165*a*/165*c*/165*b* of a socket 165. A jack, which is provided at the end of the conductive cable 202*a*, is connected to and disconnected from the socket 165. The socket 165 and jack form in combination the connector 160.

Turning back to FIG. 2, the connector 160 serves as an interface and a coupling device. The connector 160 has a clamp 162, which in tern has a turn buckle 161. The clamp 162 further has a pair of pads 163, and the distance between the pads 163 is changeable. When a player prepares the electric acoustic stringed musical instrument for his or her performance, he or she brings the pads 163 into contact with the soundboard 112 and the reverse board, and pinches the body 110 between the pads 163. Then, the connector 160 and, accordingly, one end of the conductive cable 202*a* are physically coupled to the body 110. Subsequently, the conductive cable 202 and grand line 158 are electrically coupled to the terminals 164*a*/164*b*/164*c*.

As described hereinbefore, the terminals 164*a*/164*c* are electrically connected through the contacts 203*a*/203*b* to the conductive lines 202*a* and 202*b*, and the contact 164*b* is electrically connected through the contact 159*b* and ground line 158 to the conductive metal foil 156. For this reason, the electric signals, which are representative of the vibrations, are supplied through the connector 160 and conductive cable 202*a* to the sound unit 180.

The conductive cable 202 is a coaxial cable, and the conductive lines 202*a*/202*b* are shielded with the outer conductive strip 202O. The outer conductive strip 202O is fixed at the other end thereof to the conductive metal foil 156 by means of a piece of solder 157, and the ground line 158 is also fixed at the other end thereof to the conductive metal foil 156 by means of a piece of solder 159.

As described hereinbefore, the sound unit 180 includes the control amplifier and power amplifier. The volume and balance are adjusted through the control amplifier, and effects are selectively imparted to the electric tones through the control amplifier. The tone radiator 182 is driven by means of the power amplifier for radiating the electric tones. The control amplifier, power amplifier and loud speakers are well known to persons skilled in the art, and no further description is hereinafter incorporated for the sake of simplicity.

Assuming now that a player wishes to perform a piece of music on the electric acoustic stringed musical instrument. While the player is bowing, the strings 130 vibrate, and the vibrations or lateral component force gives rise to the rolling of the bridge 200. The strain sensor 250 converts the rolling to the electric signal, and the electric signal is supplied through the connector 160 and conductive cable 202*a* to the sound unit 180. On the other hand, the player presses the bow 190 to the strings 130, and the longitudinal component force FL is exerted on the strings 130. The longitudinal component force FL is varied in the bowing, and makes the strings 130 elongated and shrunk. The elongation and shrinkage of the strings 130 gives rise to the pitching motion of the bridge 200, and the strain of the bridge 200 is converted to the electric signal by means of the strain sensor 300. The electric signal is also supplied from the strain sensor 300 through the connector 160 to the sound unit 180.

The electric signals are mixed with each other by means of a mixer in the sound unit 180. Since the longitudinal component force FL is influential in the timbre, the timbre of electric tones is varied depending upon the ratio between the magnitude of electric signal representative of the lateral component force and the magnitude of electric signal representative of the longitudinal component force FL.

When the player varies the pressure on the strings 130 for an artistic expression, the longitudinal component force FL is reduced, and the pickup unit 170 transfers the artistic expression to the electric signal. For this reason, the artistic expression is imparted to the electric tones, and the audience feels the electric tones close to the acoustic tones.

Although particular embodiments of the present invention have been shown and described, it will be apparent to those skilled in the art that various changes and modifications may be made without departing from the spirit and scope of the present invention.

The piezoelectric transducer 250 and piezoelectric film 301 do not set any limit to the technical scope of the present invention. Any type of strain sensor is available for the pickup unit 170 in so far as the alternative material has the electromotive force or strain-to-resistance characteristics varied with the force or vibrations. The piezoelectric transducers 250 may be replaced with strain gauges. The piezoelectric film may be replaced with a pressure-sensitive film or a piezoelectric polymer film.

The piezoelectric transducer 250 is replaceable with a mono-morph piezoelectric transducer. The pair of bimorph piezoelectric transducers 250 does not set any limit to the technical scope of the present invention. Only one piezoelectric transducer may be incorporated in the pickup unit 170 for converting the lateral component force to the electric signal.

The silver electrode plates 302*a*/302*b* do not set any limit to the technical scope of the present invention. Any conductive metal, alloy or synthetic resin is available for the strain sensor 300.

If a strain sensor is isotropically sensitive to not only longitudinal component force but also lateral component force, the strain sensors 250 and 300 are replaced with the isotropic sensor, and the pickup unit has only one strain sensor.

An electric acoustic stringed musical instrument according to the present invention may have a selector. In this instance, the electric signal representative of the longitudinal component force is mixed to the electric signal representative of the lateral component force when the player instructs the electric system through the selector. If the player instructs the electric system not to mix the signal component representative of the longitudinal component force, the electric tones are produced from the electric signal only expressing the lateral component force.

The electric signals may be independently amplified. In this instance, the player gives the values of gain, which expresses the gain for the electric signal expressing the lateral component force and the gain for the other electric signal expressing the longitudinal component force, to the electric system. Thus, the player can intentionally vary the timbre of the electric tones.

Another electric acoustic stringed musical instrument may be fabricated on another sort of acoustic stringed musical instrument such as, for example, a viola, a cello or a double-bass. The bowed stringed musical instrument may be replaced with a plucked stringed musical instrument such as, for example, a guitar. The present invention is applicable to an electric stringed musical instrument, the body of which does not have any resonator. Thus, the acoustic stringed musical instrument does not set any limit to the technical scope of the present invention.

Only the sound unit 180 or both of the sound unit 180 and the loud speaker 182 may be built in the acoustic stringed musical instrument. The electric stringed musical instrument with the built-in pickup unit is easy to carry and convenient for the player.

On the contrary, a manufacturer may sell the electric stringed musical instrument without the sound unit 180 and loud speaker 182. In this instance, the electric system only includes the pickup unit 170, socket 165 and conductive lines connected therebetween.

The bridge 200 may be replaceable with a standard bridge of the acoustic stringed musical instrument. In this instance, the users change the bridges depending upon the tones to be produced.

The component parts of the electric acoustic stringed musical instrument shown in the figures are correlated with claim languages as follows.

The body 110, neck 120, peg box 122, fingerboard 140 and string holder 150 as a whole constitute a "body structure", and the upper surface 112 is corresponding to a "major surface" of the body structure. One of the four strings 130 serves as "at least one string". Both of the electric signals as a whole constitute an "electric signal", and each of the electric signals serve as a "signal component".

One of the piezoelectric transducers 250 serves as "at least one piezoelectric transducer", and the piezoelectric elements 252*a*/252*b* as a whole constitute an electromotive portion. The sockets 164*a* and 164*b* serve as a "signal output terminal". The electric signal output from the sound unit 180 serves as an "audio signal", and the speakers 182 serves as a "signal-to-sound converter".

The bridge 200 serves as a "plate", and the pickup unit 170 is corresponding to a "pickup unit". The ground level is corresponding to a "constant potential level".

What is claimed is:

1. An electric stringed musical instrument for electrically producing tones, comprising:

a stringed musical instrument including a body structure having a longitudinal direction and lateral direction, a bridge held in contact with a major surface of said body structure and formed with a groove, and at least one string stretched over said major surface in said longitudinal direction and held in contact with said bridge so that vibrations thereof are propagated to said bridge; and an electric system including a pickup unit connected to said bridge for converting said vibrations to an electric signal, and including:

a vibration sensing element made in the form of film held in contact with a major surface of said bridge extending between end surfaces both held in contact with said major surface of said body structure and said at least one string, the vibration sensing element being sensitive to a component force of said vibrations in said longitudinal direction, and another vibration sensing element accommodated in said groove, physically independent of said vibration sensing element and sensitive to another component force of said vibrations in said lateral direction, so that said electric signal is produced from a signal component of said vibration sensing element and another signal component of said another vibration sensing element, said electric signal being representative of said component force and said another component force.

2. The electric stringed musical instrument as set forth in claim 1, wherein:

said vibration sensing element is a strain sensor sensitive to said component force and converting said component force to said signal component representative of said component force, and said another vibration sensing element is another strain sensor sensitive to said another component force and converting said another component force to said another signal component representative of said another component force.

3. The electric stringed musical instrument as set forth in claim 2, wherein said another strain sensor has an electromotive portion made of piezoelectric material.

4. The electric stringed musical instrument as set forth in claim 3, wherein said electromotive portion has a piezoelectric element alternatively applied with tension and compression and another piezoelectric element alternatively applied with compression and tension so as to make said electromotive portion serve as a bimorph piezoelectric transducer.

5. The electric stringed musical instrument as set forth in claim 4, wherein said bimorph piezoelectric transducer is connected to a signal output terminal in parallel to another bimorph piezoelectric transducer polarized in an opposite direction to said bimorph piezoelectric transducer.

6. The electric stringed musical instrument as set forth in claim 3, wherein a piece of plastic material fills a gap between said electromotive portion and an inner surface defining said groove.

7. The electric stringed musical instrument as set forth in claim 2, wherein said strain sensor has an electromotive layer, and is adhered to said major surface of said bridge.

8. The electric stringed musical instrument as set forth in claim 7, wherein said electromotive layer is made of piezoelectric material.

9. The electric stringed musical instrument as set forth in claim 1, further comprising a sound unit electrically connected to said pickup unit so as to produce an audio signal from said electric signal, and said audio signal contains both signal components.

10. The electric stringed musical instrument as set forth in claim 9, further comprising a signal-to-sound converter connected to said sound unit so as to produce electric tones from said audio signal.

11. A bridge incorporated in an electric stringed musical instrument, comprising:

a plate formed with a groove, the plate having major surfaces and end surfaces each narrower than one of said major surfaces, held in contact at one of said end surfaces with a body structure of said electric stringed musical instrument, and pressed to said body structure by at least one string held in contact with another of said end surfaces so that vibrations are propagated from said at least one string therethrough; and a pickup unit connected to said plate for converting said vibrations to an electric signal, and including:

a vibration sensing element made in the form of a film held in contact with one of said major surfaces of said plate, the vibration sensing element being sensitive to a component force of said vibrations in a longitudinal direction of said at least one string and another vibration sensing element accommodated in said groove, physically independent of said vibration sensing element and sensitive to another component force of said vibrations in a lateral direction crossing said longitudinal direction at right angle, so that said vibrations are converted through a signal component output from said vibration sensing element and another signal component output from said another vibration sensing element to an electric signal representative of said component force and said another component force.

12. The bridge as set forth in claim 11, wherein:

said vibration sensing element is a strain sensor sensitive to said component force and converting said component force to said signal component representative of said component force, and said another vibration sensing element is another strain sensor sensitive to said another component force and converting said another component force to said another signal component representative of said another component force.

13. The bridge as set forth in claim 11, wherein a gap takes place between said said another vibration sensing element and an inner surface defining said groove, and is filled with a piece of filler made of plastic material.

14. The bridge as set forth in claim 12, wherein said groove has a perpendicular portion extending in a perpendicular direction normal to a plane defined by said longitudinal and lateral direction and branch portions bifurcated from said perpendicular portion, and said another strain sensor has piezoelectric transducers respectively received in said branch portions.

15. The bridge as set forth in claim 12, wherein said strain sensor has an electromotive layer made of piezoelectric material.

16. The bridge as set forth in claim 12, wherein said strain sensor and said another strain sensor are connected in parallel to a signal output terminal through conductive lines, and said conductive lines are electromagnetically shielded with a conductive strip connected to a constant potential level.

* * * * *